US010121582B2

(12) United States Patent
Zheng et al.

(10) Patent No.: US 10,121,582 B2
(45) Date of Patent: Nov. 6, 2018

(54) INTEGRATED INDUCTOR

(71) Applicant: EATON CORPROATION, Cleveland, OH (US)

(72) Inventors: David Zheng, Shenzhen (CN); Wen Wang, Shenzhen (CN); Xizheng Liao, Shenzhen (CN); Denis Liu, Shenzhen (CN)

(73) Assignee: Eaton Intelligent Power Limited (IE)

( * ) Notice: Subject to any disclaimer, the term of this patent is extended or adjusted under 35 U.S.C. 154(b) by 209 days.

(21) Appl. No.: 15/103,421

(22) PCT Filed: Oct. 31, 2014

(86) PCT No.: PCT/CN2014/089971

§ 371 (c)(1),
(2) Date: Jun. 10, 2016

(87) PCT Pub. No.: WO2015/085838

PCT Pub. Date: Jun. 18, 2015

(65) Prior Publication Data

US 2016/0314888 A1 Oct. 27, 2016

(30) Foreign Application Priority Data

Dec. 12, 2013 (CN) ..... 2013 1 0683460

(51) Int. Cl.
*H01F 27/24* (2006.01)
*H01F 27/28* (2006.01)
(Continued)

(52) U.S. Cl.
CPC ..... *H01F 27/24* (2013.01); *H01F 3/10* (2013.01); *H01F 3/14* (2013.01); *H01F 27/2823* (2013.01);
(Continued)

(58) Field of Classification Search
CPC .. H01F 27/24; H01F 27/2823; H01F 27/2847; H01F 3/10; H01F 3/14; H01F 37/00; H01F 2003/06
(Continued)

(56) References Cited

U.S. PATENT DOCUMENTS 6,880,228 B2 * 4/2005 Bolotinsky ..... H01F 27/25 29/596
9,318,252 B2 * 4/2016 Liu ..... H01F 27/24
(Continued)

FOREIGN PATENT DOCUMENTS

CN 201355570 Y 12/2009
CN 202110916 U 1/2012
(Continued)

OTHER PUBLICATIONS

International Search Report Corresponding to International Application No. PCT/CN2014/089971; dated Jan. 30, 2015; 3 Pages.
(Continued)

*Primary Examiner* — Mangtin Lian
(74) *Attorney, Agent, or Firm* — Ward and Smith, P.A.

(57) ABSTRACT

An integrated inductor comprises a first winding (C1) and a second winding (C2); a first internal magnetic core in the first winding (C1) and a second internal magnetic core in the second winding (C2); and at least one external magnetic core (M) outside the first winding (C1) and the second winding (C2), used for being connected to end portions of the first and second internal magnetic cores to form a magnetic path, the external magnetic core (M) being formed by multiple sub-magnetic cores joint with each other; the magnetic conductivity of at least one sub-magnetic core of the multiple sub-magnetic cores is greater than the magnetic conductivity of other sub-magnetic cores, and the at least one sub-magnetic core at least covers a part of end faces of
(Continued)

the first internal magnetic core and the second internal magnetic core. The integrated inductor can alleviate the phenomenon of flux leakage, and can reduce costs of the magnetic cores.

10 Claims, 3 Drawing Sheets

(51) Int. Cl.
*H01F 3/10* (2006.01)
*H01F 3/14* (2006.01)
*H01F 37/00* (2006.01)

(52) U.S. Cl.
CPC ..... *H01F 37/00* (2013.01); *H01F 2003/106* (2013.01)

(58) Field of Classification Search
USPC ..... 336/212, 221, 220, 184
See application file for complete search history.

(56) References Cited

U.S. PATENT DOCUMENTS

2011/0025445 A1* 2/2011 Lai ..... H01F 3/10 336/220
2013/0147596 A1* 6/2013 Nakanoue ..... H01F 27/263 336/233

FOREIGN PATENT DOCUMENTS

| | | | |
|---|---|---|---|
| CN | 102360725 | A | 2/2012 |
| CN | 102842407 | A | 12/2012 |
| EP | 2797087 | | 10/2014 |
| GB | 162731 | A | 5/1921 |
| JP | 2013-026492 | A | 2/2013 |
| JP | 2013-038133 | A | 2/2013 |
| WO | WO 2013/118524 | | 8/2013 |

OTHER PUBLICATIONS

Supplementary European Search Report Corresponding to European Application No. EP 14869620; dated Jul. 5, 2017; 3 Pages.

* cited by examiner

INTEGRATED INDUCTOR

RELATED APPLICATIONS

The present application is a 35 U.S.C. § 371 national phase application of PCT International Application No. PCT/CN2014/089971, having an international filing date of Oct. 31, 2014, claiming priority to Chinese Patent Application No. 201310683460.4 filed Dec. 12, 2013. The disclosures of each application are incorporated herein by reference in their entireties. The above PCT International Application was published in the Chinese language as International Publication No. WO 2015/085838.

TECHNICAL FIELD

The present invention relates generally to an inductor and, more particularly, to an integrated inductor having cores comprising of a plurality of blocks.

BACKGROUND OF THE INVENTION

At present, the requirements for the design and cost of inductors are becoming increasingly high with the continuous development of high-efficiency and high-power UPS and inverter devices for meeting the market requirements and enhancing the competitiveness. The size of a core increases accordingly with the increase of the size of the inductor. However, the cost is very high to manufacture a one-piece and large-volume core. Therefore, it is usually adopted in the prior art to splice a plurality of smaller blocks into a larger core in a splicing way, and the resulted core is generally referred to as an integrated inductor.

FIG. 1 shows such an integrated inductor. As shown in FIG. 1, this integrated inductor comprises a first winding C1 and a second winding C2 connected to each other. Each of the first winding C1 and the second winding C2 wraps around a respective internal core (not shown in FIG. 1), and the two internal cores corresponding to the first winding C1 and the second winding C2 are connected by means of two external cores M located outside the windings in order to achieve a communicating magnetic circuit, wherein the distribution of the magnetic induction lines is shown substantially as the dashed arrow of FIG. 1. The external cores M need a relatively large volume. However, the manufacturing cost is very high if each of the external cores M is made of a one-piece and large-volume material. Consequently, in order to reduce the cost, each external core M is usually formed by splicing six small-volume cuboid-shaped sub-cores a, b, c, d, e and f.

However, there will be gaps between the sub-cores inevitably even if the sub-cores are spliced very closely, such as a gap G1 substantially perpendicular to the magnetic induction lines, and gaps G2 and G3 substantially parallel to the magnetic induction lines. Such gaps will result in flux leakage, which may cause a certain degree of eddy-current loss to the metal near the inductor and ultimately result in the increase of power consumption of devices comprising such inductors.

SUMMARY OF INVENTION

In view of the foregoing, an object of the present invention is to provide an integrated inductor which can weaken the flux leakage and reduce the cost of cores.

An integrated inductor is provided, comprising:

a first winding and a second winding;

a first internal core located inside the first winding and a second internal core located inside the second winding; and at least one external core formed by splicing a plurality of sub-cores and located outside the first winding and the second winding for connecting to the ends of the first internal core and the second internal core to form a magnetic circuit, wherein at least one sub-core of the plurality of sub-cores has a higher magnetic permeability than other sub-cores, and the at least one sub-core at least covers a portion of end faces of the first internal core and the second internal core.

Preferably, the at least one sub-core which has a higher magnetic permeability than other sub-cores at least covers the midpoints of the end faces of the first internal core and the second internal core.

Preferably, the at least one sub-core which has a higher magnetic permeability than other sub-cores at least covers the total areas of the end faces of the first internal core and the second internal core.

Preferably, the external core is flat-shaped.

Preferably, the at least one sub-core which has a higher magnetic permeability than other sub-cores is prismatic shaped.

Preferably, there are respectively at least one sub-core at both sides of the at least one sub-core which has a higher magnetic permeability than other sub-cores.

Preferably, there are respectively at least one sub-core at both ends of the at least one sub-core which has a higher magnetic permeability than other sub-cores.

Preferably, the ends of the external core are arc shaped.

Preferably, some of the plurality of sub-cores have arc shaped edges, and the sub-cores with arc shaped edges are located at the ends of the external core after the external core is formed.

In the integrated inductor provided by the present invention, by optimizing the position relationships between the magnetic induction lines and the gaps among the sub-cores and making the central sub-core have a higher permeability than its ambient sub-cores, the intersection of the magnetic induction lines and the gaps is avoided, in other words, less magnetic induction lines intersect with the gaps, thereby the flux leakage and the cost of the external cores are reduced.

BRIEF DESCRIPTION OF DRAWINGS

The present invention will be further explained in combination with the embodiments with reference to the accompanying figures, wherein.

DESCRIPTION OF EMBODIMENTS

In the following parts, the present invention will be described in greater details with reference to the embodiments and the accompanying drawings so as to make its objects, solutions and advantages clearer. It should be understood that the specific embodiments described herein only intend to interpret the present invention, without making any limitation thereto.

Figure 2:
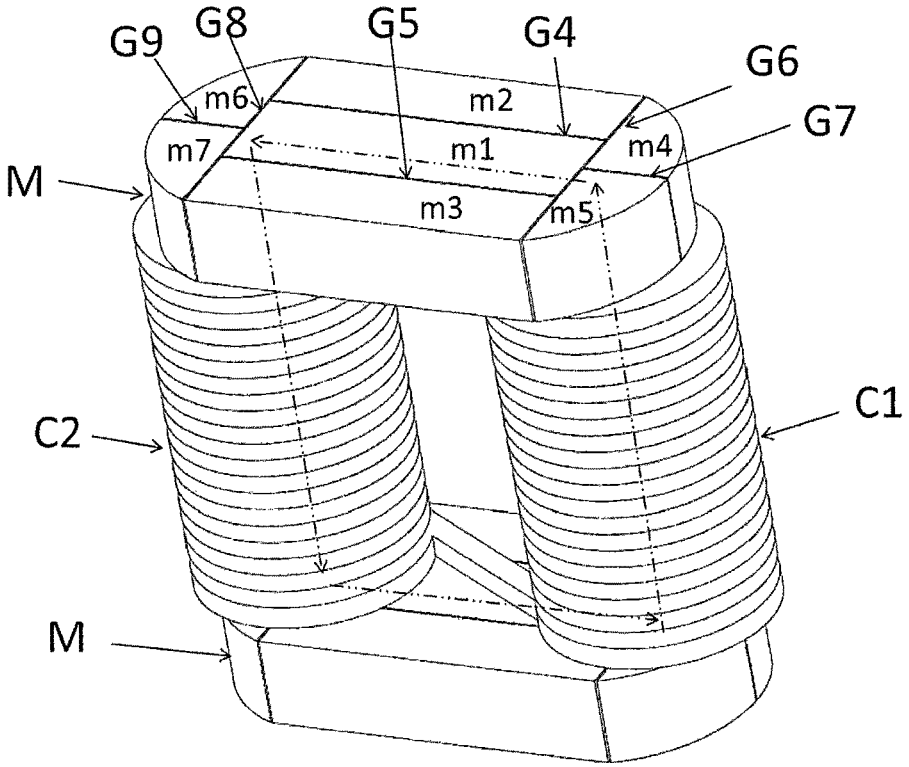
FIG. 2 is the structure diagram of an integrated inductor according to an embodiment of the present invention.

In an embodiment, an integrated inductor, the structure of which is shown in FIG. 2, is provided and the integrated inductor comprises:

a first winding C1 and a second winding C2 connected to each other, wherein, each of the first winding C1 and the second winding C2 wraps around a respective internal core (not shown in FIG. 2);

two external cores M located outside the first winding C1 and the second winding C2, wherein the two external cores M are located at both sides of the first winding C1 and the second winding C2 for connecting the internal cores located inside the first winding C1 and the second winding C2, so that the two internal cores and the two external cores M can constitute a communicating magnetic circuit (the distribution of the magnetic induction lines thereof is shown substantially as the dashed arrow of FIG. 2) together. Each external core M is formed by closely splicing a plurality of sub-cores m1, m2, m3, m4, m5, m6 and m7. The sub-cores m1, m2 and m3 are cuboids, and sub-core m1 is located between sub-cores m2 and m3. There are a gap G4 between the sub-cores m1 and m2 and a gap G5 between the sub-cores m1 and m3. The sub-cores m4, m5, m6 and m7 are fan-shaped, wherein the sub-cores m4 and m5 are spliced into a semicircular shape at a side of a unit composed of the sub-cores m1, m2 and m3, and the sub-cores m6 and m7 are spliced into another semicircular shape at the other side of the unit composed of the sub-cores m1, m2 and m3. There are a gap G7 between the sub-cores m4 and m5 and a gap G6 between the unit composed of the sub-cores m4 and m5 and the unit composed of the sub-cores m1, m2 and m3. There are a gap G9 between the sub-cores m6 and m7 and a gap G8 between the unit composed of the sub-cores m6 and m7 and the unit composed of the sub-cores m1, m2 and m3.

As shown in FIG. 2, the plurality of sub-cores m1, m2, m3, m4, m5, m6 and m7 are finally spliced into a flat external core M, which is connected to the ends of the internal cores located inside the first winding C1 and the second winding C2 at the ends thereof. The length and width of the unit composed of sub-cores m1, m2 and m3 are designed to at least cover a portion of end faces of the internal cores located inside the first winding C1 and the second winding C2, preferably at least cover the midpoints of the end faces of the internal cores, more preferably cover the total areas of the end faces of the internal cores.

The general distribution of the magnetic induction lines of the integrated inductor provided by the embodiment is shown as the dotted arrow of FIG. 2. The closer the position is from the dotted arrow, the denser the magnetic induction lines are. The magnetic induction lines traverse the internal cores inside the first winding C1 and the second windings C2 and the two external cores M, and form a complete magnetic circuit.

Research carried out by the applicant shows that in comparison with gaps parallel to the magnetic induction lines, gaps intersecting with the magnetic induction lines, in particular perpendicular to the magnetic induction lines, are more likely to induce flux leakage. Therefore it is desirable to avoid the formation of the gaps intersecting with the magnetic induction lines, in particular the gaps perpendicular to the magnetic induction lines.

In the integrated inductor of this embodiment, as shown in FIG. 2, because the unit composed of sub-cores m1, m2 and m3 at least covers a portion of the end faces of the internal cores inside the first winding C1 and the second windings C2, part of the magnetic induction lines do not traverse the gaps G6 and G8 perpendicular to the direction of the magnetic induction lines. Especially when the unit composed of sub-cores m1, m2 and m3 at least covers the midpoints of the end faces of the internal cores, a majority of magnetic induction lines do not traverse the gaps G6 and G8 perpendicular to the direction of the magnetic induction lines. More preferably, when the unit composed of sub-cores m1, m2 and m3 covers the total areas of the end faces of the internal cores, none of the magnetic induction lines traverses the gaps G6 and G8 perpendicular to the direction of the magnetic induction lines in the external cores M. This can significantly reduce the flux leakage in comparison with the case shown in FIG. 1 (all the magnetic induction lines traverse the gap G1 perpendicular to the magnetic induction lines).

According to another embodiment of the present invention, the sub-core m1 has a higher permeability than other sub-cores m2, m3, m4, m5, m6 and m7. The length and width of the sub-core m1 are designed to make the sub-core m1 at least cover a portion of the end faces of the internal cores inside the first winding C1 and the second windings C2, preferably at least cover the midpoints of the end faces of the internal cores, more preferably cover the total areas of the end faces of the internal cores.

Because the permeability of the sub-core m1 is higher than those of the sub-cores m2 and m3, more magnetic induction lines are concentrated into the sub-core m1, such that the magnetic induction lines near the gaps G4 and G5 in parallel with the magnetic induction lines are relatively sparse, thereby the influence of the gaps G4 and G5 in parallel with the magnetic induction lines is further lessened, and then the flux leakage is further reduced. Moreover, because the permeability of the sub-core m1 is higher than those of the sub-cores m4, m5, m6 and m7, and the sub-core m1 at least covers a portion of end faces of the internal cores (preferably covers the midpoints of end faces of the internal cores, and more preferably covers the total areas of end faces of the internal cores), more magnetic induction lines induced from the internal cores are concentrated into the sub-core m1, and only a small part of magnetic induction lines traverse sub-cores m4, m5, m6 and m7, thereby the magnetic induction lines traversing the gaps G6 and G8 are further reduced, and then the flux leakage is further reduced.

In addition, the integrated inductor according to the embodiment can also reduce the cost of the external cores M. Generally speaking, materials with higher permeability will be more expensive, and the permeability must reach a threshold value in order to meet the requirements of the inductors Therefore, it is difficult to reduce the prices thereof. In the integrated inductor provided by the embodiment, the sub-core m1 has a higher permeability than other sub-cores m2, m3, m4, m5, m6 and m7. The volume of the sub-core m1 with higher price and higher permeability only occupies a small part of that of the external cores M, and other sub-cores may be formed by using materials with lower price and lower permeability. The total cost of the whole external cores can be reduced by means of designing the plurality of sub-cores to have different permeabilities. As for the specific permeability values and the volume fraction of the sub-core m1, a person skilled in the art may easily obtain preferable solutions according to the permeability values and the market price of various materials without creative labor.

Figure 1:
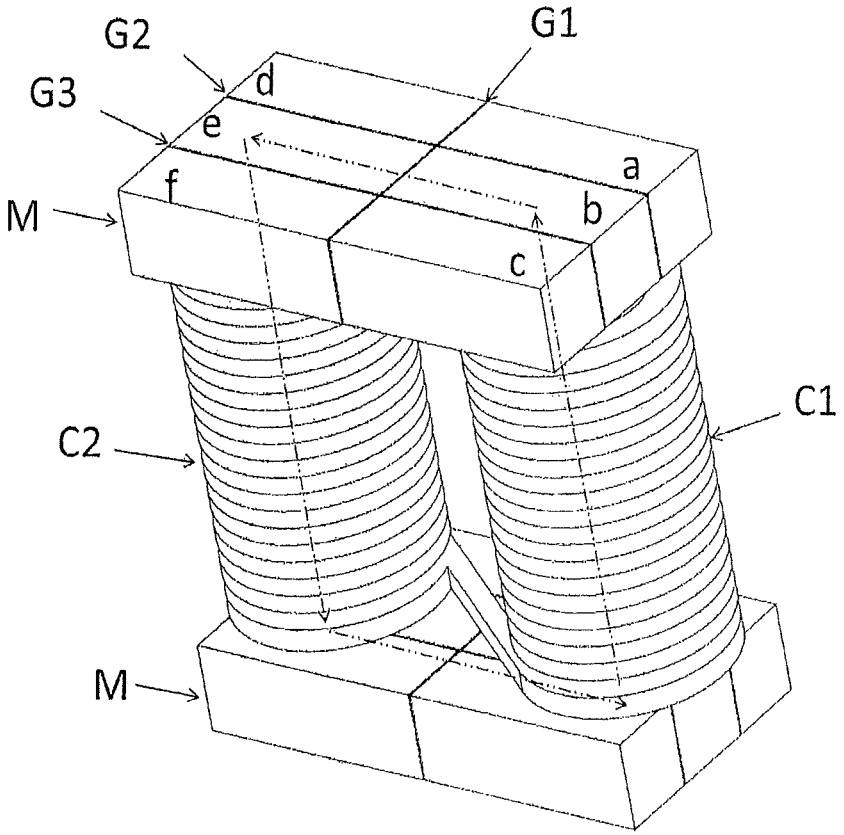
Fig.1 PRIOR ART
FIG. 1 is the structure diagram of a prior integrated inductor.

Moreover, since the sub-cores m4, m5, m6 and m7 are designed to be fan-shaped, the volume and weight of the external cores can be reduced in comparison with the rectangular external cores shown in FIG. 1. In addition, the fan-shaped sub-cores m4, m5, m6 and m7 have arc-shaped edges, in comparison with the rectangular external cores shown in FIG. 1, under the same external conditions, the former makes the corners of the external cores M farther away from the ambient metal parts and thus the eddy-current interference to the metal parts are lessened.

Figure 3:
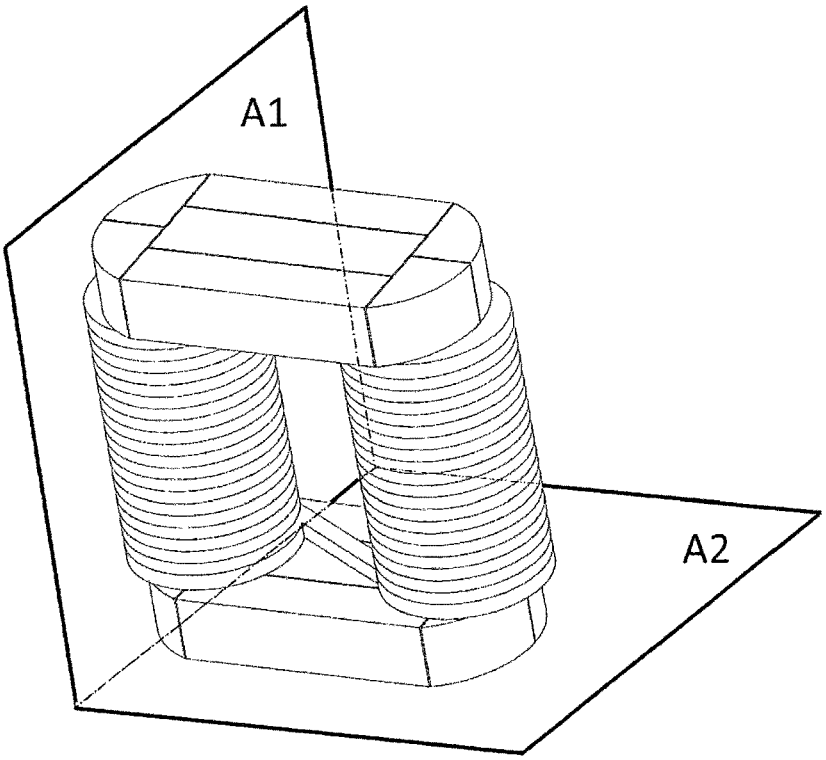
FIG. 3 shows the position relationship between the integrated inductor according the embodiments of the present invention and the test aluminum sheets A1 and A2.

In order to demonstrate the advantages of the integrated inductor provided by this embodiment, the integrated inductor is simulated and the eddy-current loss created in metal sheets A1 and A2 near the integrated inductor is calculated. In this embodiment, the sub-core m1 covers the midpoints of the end faces of the internal cores. FIG. 3 shows the position relationship between aluminum sheets A1 and A2 near the integrated inductor. Wherein, the aluminum sheet A1 is located near one end of the two external cores M, near sub-cores m6 and m7, and is perpendicular to a plane defined by the first winding C1 and the second winding C2. The aluminum sheet A2 is parallel to one of the external cores M.

Figure 4:
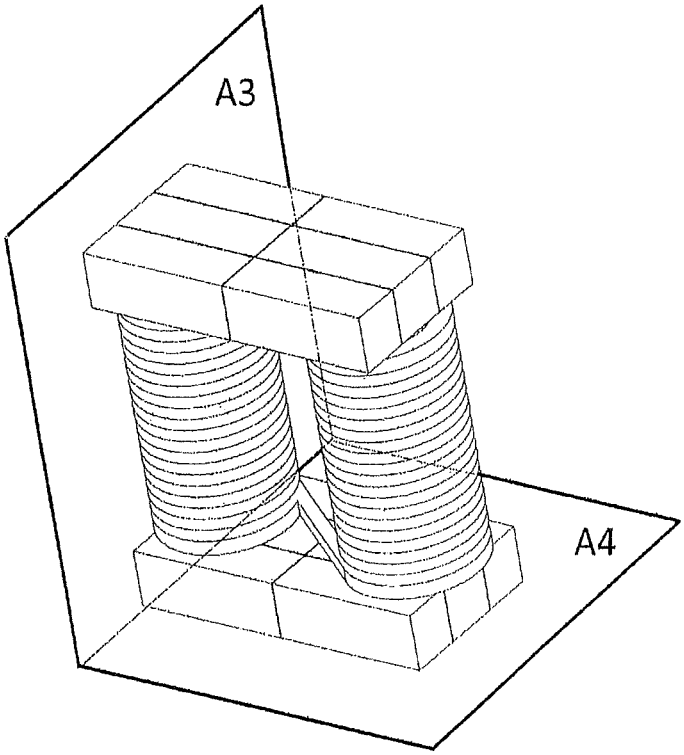
Fig.4 PRIOR ART
FIG. 4 shows the position relationship between the prior integrated inductor and the test aluminum sheets A3 and A4.

In contrast, the prior integrated inductor shown in FIG. 1 is also simulated, and the eddy-current loss created in aluminum sheets A3 and A4 near the integrated inductor is also calculated. The positions of aluminum sheets A3 and A4 are shown in FIG. 4, which are corresponding to the positions of A1 and A2 with respect to the present integrated inductor.

The simulation results show that the eddy-current loss of the metal sheet A1 near the integrated inductor provided by this embodiment decreases by 22.2% with respect to the eddy-current loss of the metal sheet A3 near the prior integrated inductor. And the eddy-current loss of the metal sheet A2 near the integrated inductor provided by this embodiment decreases by 29% with respect to the eddy-current loss of the metal sheet A4 near the prior integrated inductor.

In view of above, by optimizing the position relationships between the magnetic induction lines and the gaps among the sub-cores and making the sub-core m1 have a higher permeability than other sub-cores m2, m3, m4, m5, m6 and m7, the integrated inductor of the present invention tries to avoid the intersection of the magnetic induction lines and the gaps, in other words, make less magnetic induction lines intersect with the gaps, thereby the flux leakage and the cost of the external cores are reduced.

The shapes of various sub-cores described in the above embodiment are not limitations to the present invention, and a person skilled in the art is able to make various modifications to the solutions of the present invention. For example, according to another embodiment of the present invention, the sub-cores m1, m2 and m3 may be prismatic shaped with rhombic cross-sections, and may also be other shapes being able to be matched with each other and spliced into a whole body. The sub-cores m4, m5, m6 and m7 may also be other shapes with arc-shaped edges other than fan-shape, which can also realize the object of the present invention.

According to another embodiment of the present invention, the external cores may be formed by splicing more sub-cores. For example, there may be more sub-cores outside the sub-cores m2 and m3.

According to another embodiment of the present invention, the windings C1 and C2 can be electrically connected or un-electrically connected.

According to another embodiment of the present invention, the ends of the external cores are preferably arc, more preferably semicircle, and most preferably semicircle coinciding with the circular section of the internal cores. Thereby, the requirement of permeability is satisfied and the cost is minimized.

It should be noted that the "gap(s)" of the present invention are gaps introduced unavoidably by splicing, rather than gaps created deliberately. It is well known by a person skilled in the art that it is expected to make the gaps between various sub-cores smaller, in order to avoid flux leakage as far as possible.

It should be also noted that the embodiments described above are only used to explain the solutions of the present invention, rather than limitations to the present invention. Although the present invention has been described in terms of the preferred embodiment, it is recognized by a person skilled in the art that equivalents, alternatives, and modifications, aside from those expressly stated, are possible and within the scope of the appending claims.

The invention claimed is:

1. An integrated inductor, comprising:

a first winding and a second winding;

a first internal core located inside the first winding and a second internal core located inside the second winding; and at least one external core comprising a plurality of sub-cores and located outside the first winding and the second winding, the at least one external core, the first internal core and the second internal core forming a magnetic circuit, wherein at least one sub-core of the plurality of sub-cores has a higher magnetic permeability than at least one other sub-core of the plurality of sub-cores, wherein the at least one sub-core at least partially overlaps end faces of respective ones of the first internal core and the second internal core, and wherein first and second ones of the at least one other sub-core of the plurality of sub-cores are disposed on respective first and second lateral sides of the at least one sub-core which has a higher magnetic permeability.

2. The integrated inductor of claim 1, wherein the at least one sub-core which has a higher magnetic permeability overlaps the end faces of the first internal core and the second internal core to midpoints thereof.

3. The integrated inductor of claim 1, wherein the at least one sub-core which has a higher magnetic permeability completely overlaps the end faces of the first internal core and the second internal core.

4. The integrated inductor of claim 1, wherein the external core is flat-shaped.

5. The integrated inductor of claim 1, wherein third and fourth ones of the at least one other sub-core of the plurality of sub-cores are disposed on respective first and second ends of the at least one sub-core which has a higher magnetic permeability than other sub-cores.

6. The integrated inductor of claim 1, wherein ends of the external core are arc-shaped.

7. The integrated inductor of claim 1, wherein some of the plurality of sub-cores have arc-shaped edges, and the sub-cores with arc-shaped edges are located at ends of the external core.

8. An apparatus, comprising:

a magnetic core comprising first and second substantially parallel core portions and third and fourth core portions at least partially overlapping respective first and second ends of the first and second core portions, wherein the third and fourth core portions comprise respective first and second pluralities of discrete magnetic material segments including at least one segment having a higher magnetic permeability than other ones of the segments, wherein the at least one segment having a higher magnetic permeability comprises a first elongate magnetic material bar and wherein the segments further comprise second and third elongate magnetic material bars disposed on respective first and second lateral sides of the first elongate magnetic material bar and having a magnetic permeability less than that of the first elongate magnetic material bar; and first and second windings on respective ones of the first and second core portions.

9. The apparatus of claim 8, wherein the third and fourth core portions comprise arc-shaped magnetic material regions disposed at ends of the first, second and third elongate magnetic material bars.

10. The apparatus claim 8, wherein the first and second windings are electrically connected.

* * * * *